US005208932A

United States Patent [19]

Muller

[11] Patent Number: 5,208,932

[45] Date of Patent: May 11, 1993

[54] CABLE-STAY BRIDGE AND METHOD FOR CONSTRUCTION THEREOF

[75] Inventor: Jean M. Muller, Suresnes, France

[73] Assignee: Societe Centrale d'Etudes et de Realisations Routieres-Scetauroute, Paris, France

[21] Appl. No.: 690,789

[22] Filed: Apr. 25, 1991

[30] Foreign Application Priority Data

Apr. 25, 1990 [FR] France ..... 90 05257

[51] Int. Cl.[5] ..... E01D 11/00

[52] U.S. Cl. ..... 14/21

[58] Field of Search ..... 404/21, 22, 19

[56] References Cited

U.S. PATENT DOCUMENTS

| | | | |
|---|---|---|---|
| 495,621 | 4/1893 | Balet | 14/19 X |
| 3,864,776 | 2/1975 | Hedefine et al. | 14/21 |
| 4,866,803 | 9/1989 | Nedelcu | 14/19 |

FOREIGN PATENT DOCUMENTS 447247 3/1968 Switzerland .

OTHER PUBLICATIONS

Travaux, No. 562, Jan. 1982, pp. 25–46; E. Brassard et al., "la passerelle de meylan (Isere)".

*Primary Examiner*—William P. Neuder

*Attorney, Agent, or Firm*—Stevens, Davis, Miller & Mosher

[57] ABSTRACT

A bridge of the cable-stay type, in particular of a very large span, the deck of which is supported by stays deflected by passing over towers (21). Some of the stays (22) are anchored on the deck at two points of the deck situated on either side of a same tower (21), and the central part of a span between two towers is supported exclusively by other stays (25) which, after having been deflected at the top of a tower, are each anchored in an anchor block (26). The tensile stress to which the central part of the deck is subjected under the effect of these stays (25) directed towards the tops of the two towers situated on either side of the span is compensated for by an axial compressive prestress.

10 Claims, 6 Drawing Sheets

CABLE-STAY BRIDGE AND METHOD FOR CONSTRUCTION THEREOF

BACKGROUND OF THE INVENTION

The present invention relates to a bridge, in particular a bridge of a very large span, of the type comprising a deck, at least two towers and a certain number of cables or stays connecting the tops of the towers to the deck in order to support the latter.

Hitherto, bridges of a very large span (greater than 1000 m) have been constructed with suspended decks. The most simple form of these known structures comprises one or more main suspension cables, tensioned between two towers, above which they are deflected in order to be anchored at the end of the side spans in powerful anchor blocks. The deck carrying the traffic (road, railway, fluid conduits, etc.) is suspended from the suspension cables by suspenders which are generally approximately vertical and regularly spaced out along the length of the structure.

With the materials currently available (framework steel and steel for suspension cables), the maximum clear span of such structures is greater than 3000 m; however, the cost of the suspension cables and of the anchor blocks increases extremely quickly with the span. Furthermore, the vertical deformations of the deck and the variations in the longitudinal inclination of the latter under the passage of the moving loads (lorries or trains) soon become critical. In order to limit the bending and rotations to acceptable values, structures must be built which are highly surbased and in which the height of the towers above the deck is 1/10 to 1/9 of the clear span, in other words the distance between two successive towers. This limitation further increases the weight and the cost of the suspension cables and of their anchor blocks.

In order to overcome these disadvantages, for approximately the last thirty years engineers have turned to cable-stayed bridges. The deck is suspended from multiple stays distributed uniformly over its length, generally in an approximately symmetrical manner on either side of each tower The vertical loads of the deck are divided into a tension sustained by the stays and a compression sustained by the deck. The tensions of the stays are generally selected in such a way that the reaction force imposed on the tower is vertical, with the result that the compressions in the deck are balanced on either side of the tower. The height of the towers can be selected to be much larger than for suspension bridges 1/5 to 1/4.5 of the clear span, with the result that the cost of the stays is reduced whilst increasing the rigidity of the structure. Lastly, the anchor blocks are no longer necessary, which represents a considerable saving in the overall cost of the structure.

On the other hand, the deck is now subjected to substantial compressive forces which must be taken into account in the calculations. For a deck sustaining a total load (permanent loads +moving loads) w per unit length, and assuming that all the stays are anchored to the top of the tower, the axial compressive force N in the deck varies parabolically from zero (at the crown of the central span or at the end of the side span) to a maximum value at right angles to the tower equal to $N=wa^2/2h$, a being the distance from the tower to the crown of the central span or to the end of the side span, and h being the height of the tower above the deck. It can be seen that a doubling of the span, all other things being equal, results in a quadrupling of the compressive load. (For the sake of simplification, the weight of the stays has been ignored in this expression). With the properties of the current materials, the limit span of a cable-stayed bridge lies between 1000 and 1500 m; it is determined by the exhaustion of the compressive strength of the deck under the effect of the axial force (plus, of course, the various thermal effects and the bending moments created by the passage of the moving loads).

In its field of application, the cable-stayed bridge is more rigid than a suspension bridge and substantially more economical. This intrinsic advantage is confirmed by the fact that in the last twenty years, 10 times more cable-stayed bridges have been constructed than suspension bridges in the range of clear spans from 200 to 800 m.

In order to widen the field of application of cable-stayed bridges beyond their current limit span, the idea was mooted of combining the two systems of staying and suspension. In its most simple form, this combination consists in constructing, from each tower, two traditional cable-stayed decks over a first length on either side of each tower. The central part of the main gap, over a second length on either side of the crown, is then suspended from a cable which is itself anchored in external blocks by vertical suspenders. Such a solution is described, in particular, in "Connaissance des ouvrages d'art No 3-4, 1988-89: Darius Amir-Mazaheri A 3000-meter bridge - an advance in the study thereof", pages 68-71.

More complex, so-called "net and lattice" solutions have also been proposed, see in particular "Cable supported Bridges, Concept and Design", by Niels GIMSING, published by John Wiley and Sons, pages 176-183. In the structure proposed by this author, it is possible to distinguish deck parts supported in the traditional manner by stays anchored at each of their ends at points situated on either side of towers these stays being deflected at the top of the corresponding tower; these deck parts being followed, towards the middle of the central span, by cable-stayed parts in which the stays, at their other end, are anchored in an anchor block situated beyond the side span. The bridge furthermore comprises a short central part which is supported, via vertical or inclined suspenders, by a suspension cable which joins the same anchor blocks to the ends of the bridge. There may also be a partial overlapping between this "suspended" part and the adjacent cable-stayed part. The horizontal forces resulting from the action of the weight of the deck on the stays and the suspenders are balanced by a compressive force in the cable-stayed parts of the deck, a tensile force in the central part of the deck, and a tensile force in the suspension cable. It is possible, for example, to calculate the lengths of the parts of the bridge in such a way that these three forces are equal.

These mixed solutions have as yet not got beyond the designer stage and no structure of this type has been made. This is probably because such designs attempt to combine in one and the same structure two fundamentally different techniques: stays on the one hand and suspension cables and suspenders on the other hand. Not only are the structural behaviours different, but the materials and the technology for the construction are also very different.

It has also been proposed, Swiss Patent 447,247, to support the central part of the span exclusively by stays which are anchored, on the one hand, in anchor blocks situated beyond the deck and are deflected in the upper part of the towers, and, on the other hand, towards the ends of the central part. This central part is then subjected, between the stays which are deflected by one tower and those which are deflected by the other, to a considerable tensile stress, which limits the dimensions which it is possible to give this central part.

The object of the present invention is to eliminate such difficulties and thus to bring multiple-cable-stayed bridges into the range of span previously reserved for suspension bridges.

SUMMARY OF THE INVENTION

The invention consequently provides a bridge comprising a deck and at least two towers, the part of the deck which extends on either side of each tower being supported by stays which are anchored on the deck and tensioned between their anchorage points on the deck and points situated at the top of the tower or distributed over the height of the latter, the longitudinal compressions in this part of the deck which result from the tensioning of the stays being approximately balanced on either side of the tower, the deck furthermore comprising a central part situated approximately half-way between two successive towers and which is supported exclusively, from these two towers, by stays which are anchored, on the one hand, in this central part of the deck and, on the other hand, on one or other of two anchor blocks beyond the deck, and are each deflected at the top of the tower situated between said central part and said anchor block, which has as its feature that the central zone of the deck is subjected to an axial prestress, calculated in order to compensate at least partially for the tensile stress to which the central part is subjected under the effect of the said stays anchored on the anchor blocks.

There is no departure from the invention if the stays have a discontinuity at the level of a tower and consist, for example, of a part anchored on the deck and on the tower and of a part anchored on the tower and on the anchor block. The part of the tower which connects these two anchorage points ensures the continuity of the transmission of the forces and can thus be considered as part of the stay.

The prestress is advantageously calculated in order to balance substantially the maximum tensile load half-way between the towers.

The zone subjected to the prestress corresponds, in a simple manner, to the central part mentioned above. In particular, a slightly longer prestressed zone would make it possible to reduce further the compressive stress at right angles to the towers, where it is greatest, but it would give rise to an imbalance which would have to be compensated for, for example by exerting a tension on the deck from the anchor blocks.

It is also possible to reduce the effect of the compressive stresses by providing, in a known manner, that the stressed cross-section of the deck changes along the length of the structure in order to adapt to the variation in the forces which it sustains.

The practical value of the design of the invention presupposes that the problems of construction of the structure can be overcome.

The invention consequently also provides a process for the construction of a bridge as defined above, and which comprises the following stages:

constructing the anchor blocks and, simultaneously or independently, erecting the towers and constructing the parts of the deck which are supported by stays anchored on these deck parts on either side of the tower, putting in place, between each deck part already constructed and the adjacent anchor block, jacks or removable members capable of transmitting a horizontal reaction force, constructing the central part of the deck with the aid of stays anchored in the anchor block, working from the deck parts already constructed and compensating for the imbalance in the horizontal forces with the aid of the jacks or the removable members, keying the centre of the deck, applying the prestress to the central part of the deck.

During the construction, the part of the deck which is adjacent to the towers is subjected to compressive forces which are greater than those which it is intended to sustain in service, when the bridge is not loaded. This temporary overload should be compared with the additional overloads which will result from the use of the bridge. If necessary, its effects could be compensated for by providing for the stressed crosssection of the deck to change along the length of the structure in order to adapt to the variation in the maximum forces which the said deck must sustain during construction.

It is also possible to construct the deck of the central part in several stages, the keying of the centre of the deck taking place before the deck has its final form and weight.

According to an advantageous modus operandi, during the construction of the central part, the symmetrical stays of the family of stays intended to support this central part are balanced in pairs by connecting these stays together using ties fixed in proximity to their anchorage point on the deck.

Furthermore, it is advantageous to apply this prestress to the central part of the deck in a gradual manner by simultaneously relaxing the force of the jacks or removable members.

BRIEF DESCRIPTION OF THE DRAWINGS

The invention will now be explained in more detail with the aid of illustrative embodiments illustrated in the drawings and in which.

DETAILED DESCRIPTION OF THE INVENTION

Figure 1:
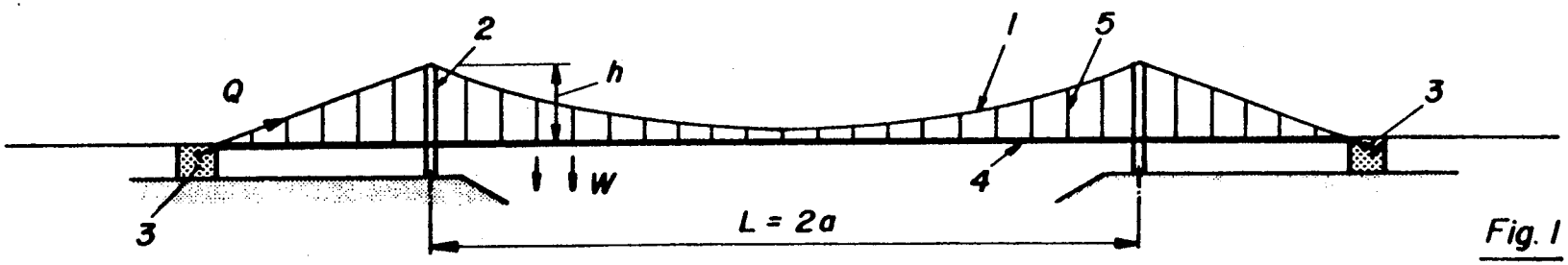
FIG. 1 is a diagrammatic view in elevation of a suspension bridge.

FIG. 1 shows a conventional suspension bridge in which one or more main suspension cables 1 pass over the top of two towers 2 and are anchored in anchor blocks 3. The deck 4 is suspended from the cables by suspenders 5 which are here shown to be vertical and regularly spaced apart. The weight W of the elements of the deck is compensated for by the tensioning of the suspenders 5, and lastly the total weight of the deck is compensated for by a tension Q exerted by the cables on the anchor blocks.

Although the example envisages only two towers, it is, of course, possible to provide a larger number of them. This is, moreover, applicable in the entire description below.

Figure 2:
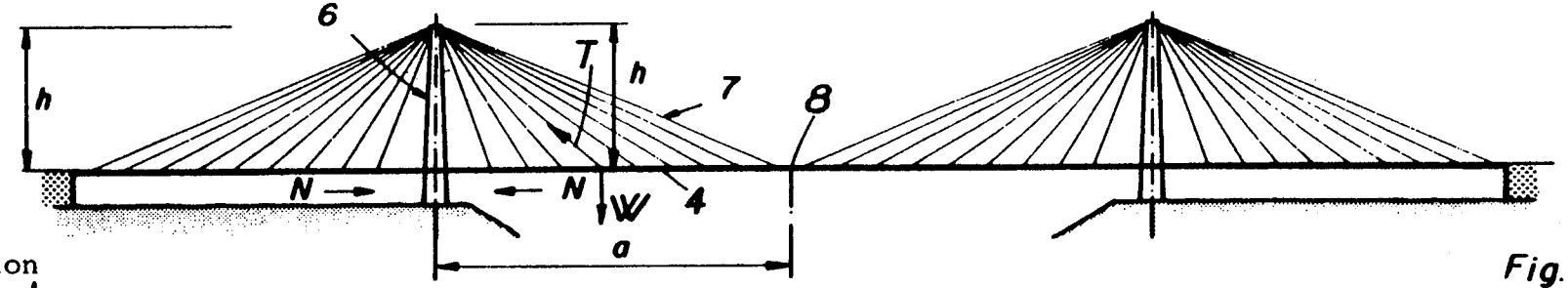
FIG. 2 is a diagrammatic view in elevation of a conventional cable-stayed bridge.
Figure 3:
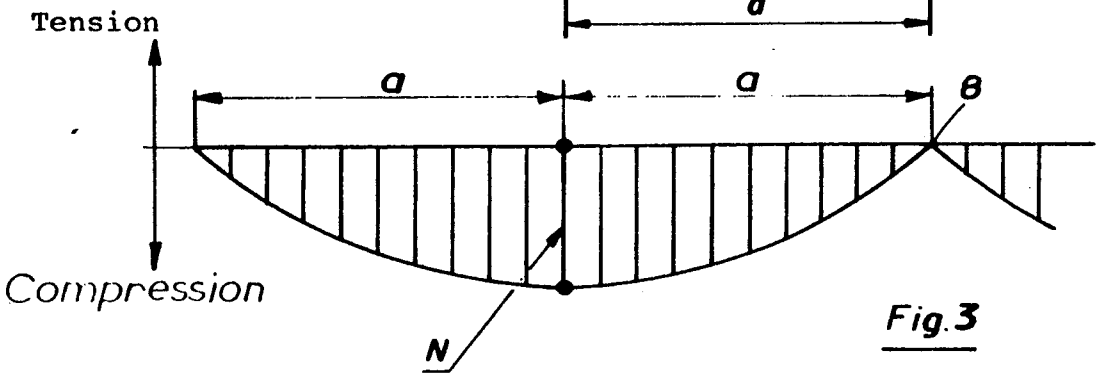
FIG. 3 is a diagram of the axial stresses of the deck of the bridge in FIG. 2.

FIG. 2 shows a cable-stayed bridge of the conventional type, in which the two towers 6 each carry half the length of the deck 4 via stays 7, the ends of which are anchored on either side of the tower in a substantially symmetrical manner. The deck is therefore split up by the towers and the crown of the span into four substantially equal lengths a. The vertical load W of the deck generates an axial compression N of the deck between two symmetrical stays. As shown in FIG. 3, this compressive force is maximum at right angles to the towers 6, and it is zero at the end of the side span and at the crown 8 of the central span. As mentioned above, this maximum force is equal to $N=W\ a^2/2h$.

Figure 4:
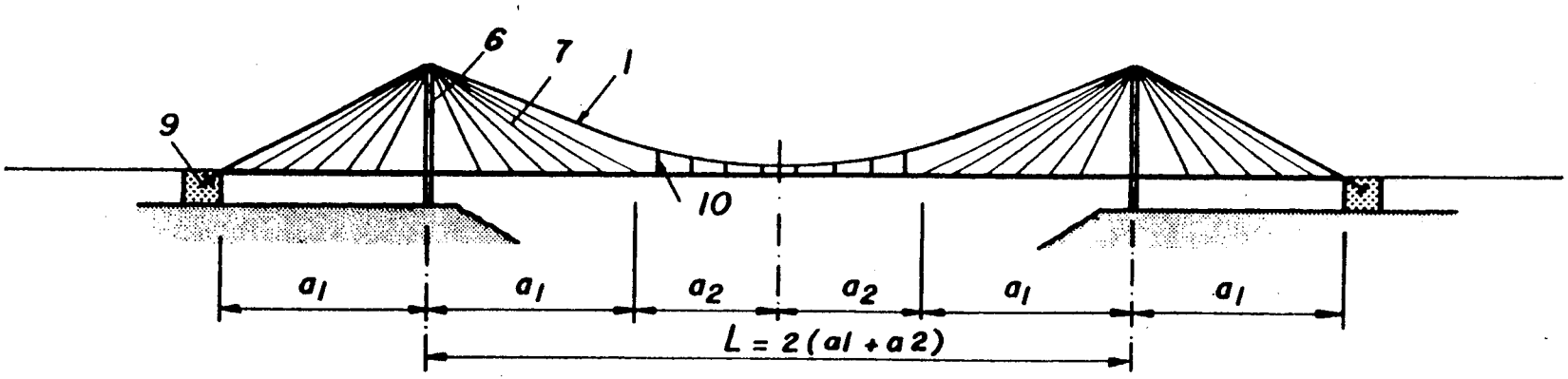
FIG. 4 is a diagrammatic view in elevation of a mixed cable-stayed/suspension bridge.

FIG. 4 shows a bridge of the "mixed" type, such as that which has been proposed. On either side of the tower 6, a deck part of length $a_1$ is supported by stays 7, in the same manner as in the case of FIG. 2. Furthermore, a suspension cable 1 similar to the cable 1 in FIG. 1 passes over the top of the towers 6, is retained by anchor blocks 9 placed on either side of the bridge, and supports, via vertical suspenders 10, a central part of the deck of total length $a_2$. The total span of the bridge between two towers is equal to $L=2(a_1 + a_2)$.

Figure 5:
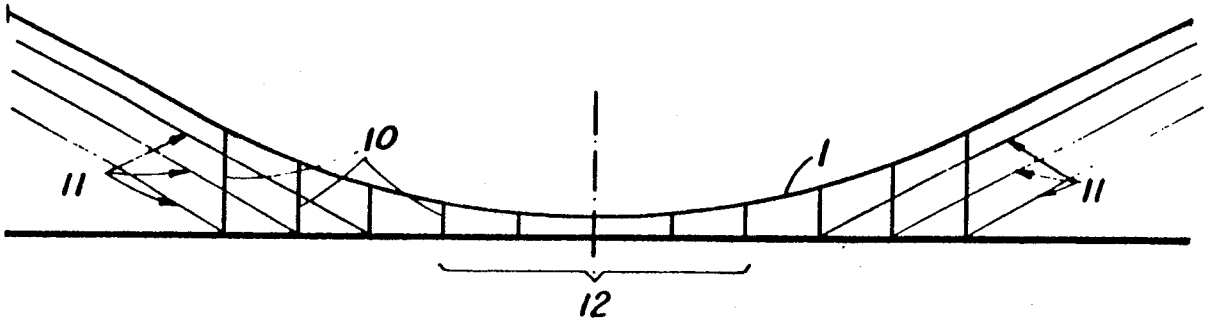
FIG. 5 is a detailed view of the bridge in FIG. 4.
Figure 6:
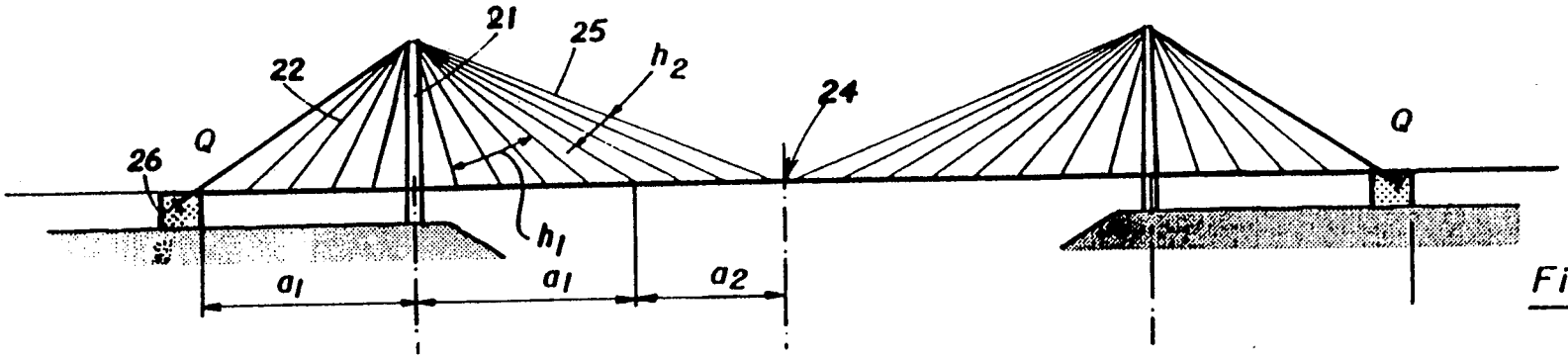
FIG. 6 is a diagrammatic view in elevation of a bridge according to the invention.

FIG. 5 shows the gradual transition between the purely cable-stayed part of the deck and its purely suspended part. In addition to the suspenders 10, cables 11 are anchored to the deck, in the vicinity of the purely cable-stayed part. These cables 11, after being passed over the top of the towers 6, are anchored on the anchor block 9.

The middle part 12 of the deck is supported solely by suspenders 10.

FIGS. 6 to 9 relate to a bridge according to the invention. In this bridge, the length of the deck is divided into three parts: two parts 20, cable-stayed in the conventional manner, each situated on either side of a tower 21 and each supported by a series of cables 22 anchored symmetrically with respect to the tower and deflected at the top of the latter, and a central part 23 situated on either side of the crown 24 of the central span and supported by stays 25 which, after having been deflected at the top of the tower 21, are anchored in an anchor block 26.

It will be noted that, instead of the described arrangement of the stays 25, which is termed "fanshaped", it is possible to provide, without departing from the invention, an arrangement of the "harp-shaped" type in which the stays reach the tower at separate points distributed over the height of this tower. Neither is there any departure from the invention if the stays do not extend continuously from an anchorage point on the deck but consist of two sections which are each anchored on the tower and on the deck.

Figure 7:
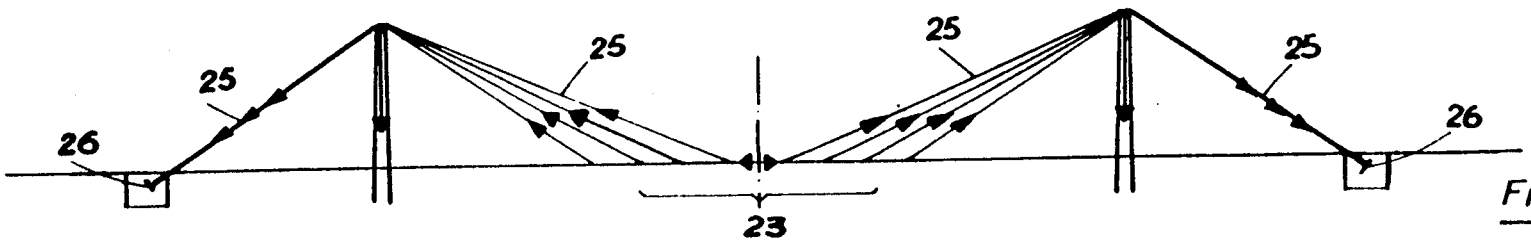
FIG. 7 is a diagram showing the distribution of the stresses in the central part and the corresponding stays.

FIG. 7 shows that, from one anchor block 26 to the other, there is a series of tensioned elements consisting of the stays 25 of a first half of the central part, the deck of the central part 23 itself, and the stays situated on the other side of this central part.

Figure 8:
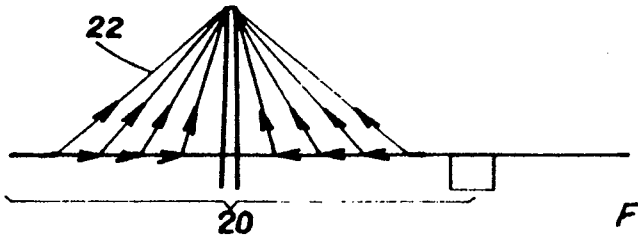
FIG. 8 is a diagram similar to that in FIG. 7 and showing the distribution of the stresses on the part adjacent to a tower.

FIG. 8 shows, on the other hand, that, in the conventional cable-stayed part, the load is balanced by the tension of the stays 22 and the compression of the deck.

Figure 9:
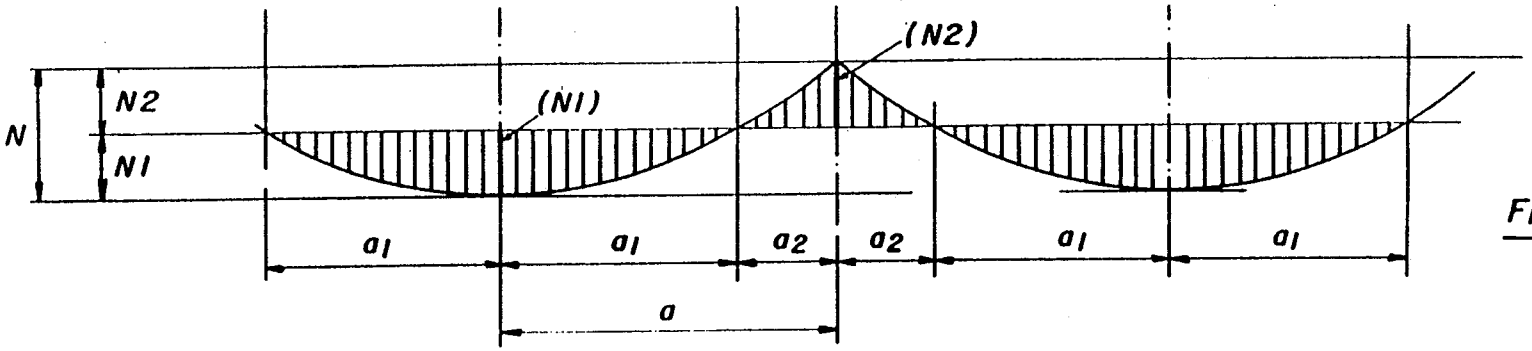
FIG. 9 is a diagram of the stresses of the deck of the bridge in FIG. 6.

As shown in FIG. 9, the stays 25 therefore do not produce any additional compression in the deck on its portion adjacent to each tower. However, the equilibrium in the loads between the stays and the deck in the central part of the latter induces a series of axial tensile forces which accummulate and give rise to a total axial force $N_2$ at the crown of the central span. Ultimately, the axial force N in the deck of the central span, created by the horizontal component of the forces of the stays and which, in a conventional cable-stayed bridge, would have just been a compressive force, can be broken down, according to the arrangements of the invention, into a compressive force $N_1$ in the part adjacent to the tower and a tensile force $N_2$ in the central part. Assuming that the loads W are constant along the length of the deck and ignoring the influence of the weight of the stays, it can easily be found that, if $a_1=0.7$ a is selected, i.e. $a_2=0.3$ a, then $N_1=N_2=N/2$. It is thus possible, with the same properties of materials, to increase the distance of the central span in the rate of: $1/0.7=1.4$, if it is assumed that the acceptable compressive and tensile loads are identical.

In fact, it is possible to go much further by employing a second arrangement of the invention. In the deck, the tensile forces $T_2$ balancing the horizontal component of the tensions $T_1$ of two symmetrical stays in the central part 23 (FIG. 7) can be compensated for by a prestressing force within the deck (irrespective of the material of which it is composed — steel or concrete), preferably calculated in such a way that, when the deck sustains its permanent loads and its moving loads, the axial force at the crown of the central span is zero.

The result then is that, when the deck sustains only its permanent loads, it is subjected, in the central span, to a compressive force $N_1$ equal to the prestress less the tensile stress produced at this moment by the stays 25, and hence equal to the additional tensile force which results from the moving loads.

Figure 10:
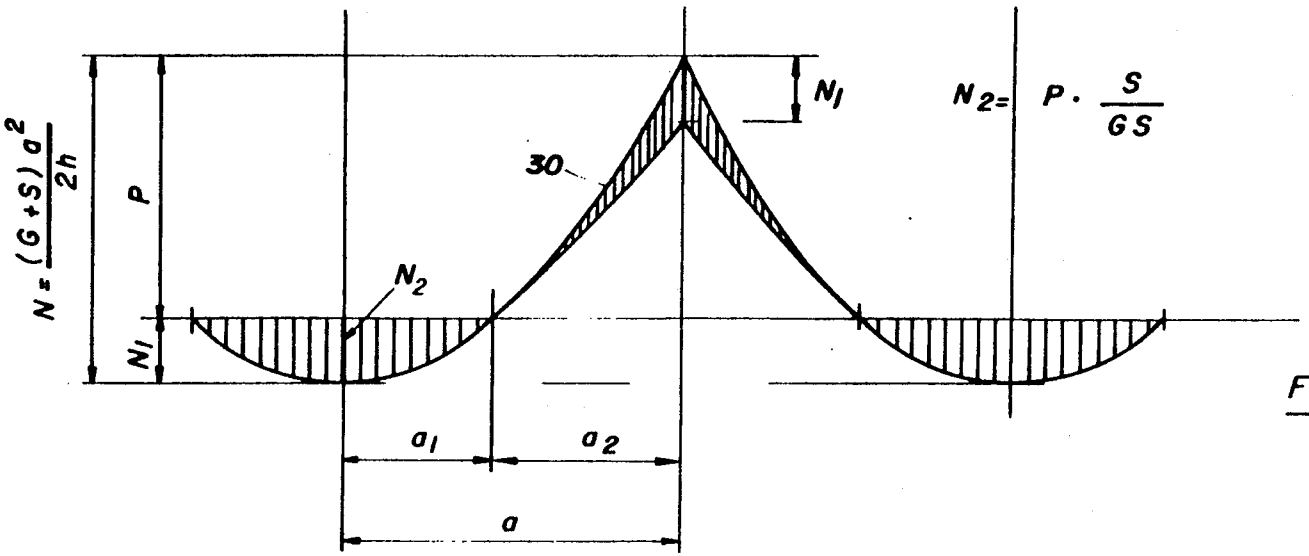
FIG. 10 is a diagram of the stresses in the deck of a preferred alternative embodiment.

In a road bridge of large span, greater than 1000 m for example, the permanent loads G are three times greater than the moving loads S. As a result, the prestressing force is equal to $4N_1$. Assuming that the maximum compressive load at the crown $N_1$ can be equal to the maximum compressive load near --------- the tower $N_2$, this gives the diagrammatic layout in FIG. 10 in which the parabolic curve 30 has as its equation $N=(G + S)$ $a^2/2h$, which is the equation which corresponds to a conventional cable-stayed bridge. It can be seen that $N = 5N_2$ at the most, which means that the term $a^2$ is five times greater than what it would have been in a conventional cable-stayed bridge. The span is therefore multiplied by $\sqrt{5}=2.25$ approximately and can hence attain values comparable to those of large suspension bridges.

Figure 11A:
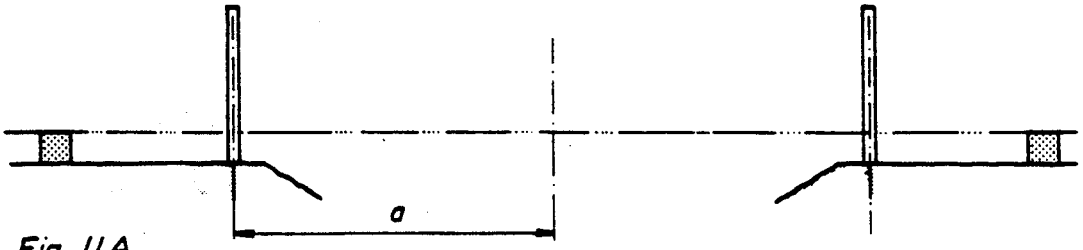
FIGS. 11A, 11Bm 11C are diagrams showing stages in the construction of a bridge according to the invention.
Figure 13:
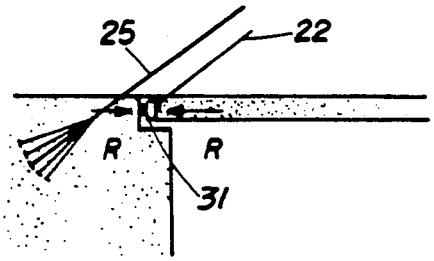
FIG. 13 is a detail of FIG. 11C.

The practical value of the new design proposed according to the invention assumes, however, that all the problems of the construction of the structure can be overcome. The foundations, towers and anchor blocks being made beforehand (FIG. 11A) the deck is constructed on either side of each tower in an approximately symmetrical manner, employing the corresponding stays 22 at each stage. When this stage of the work is finished, the side spans are completed (FIG. 11B) and adjusting jacks 31 (FIG. 13) capable of transmitting a horizontal reaction force R will be arranged in the joint separating the end of the deck and the corresponding anchor block on which it rests.

Figure 12:
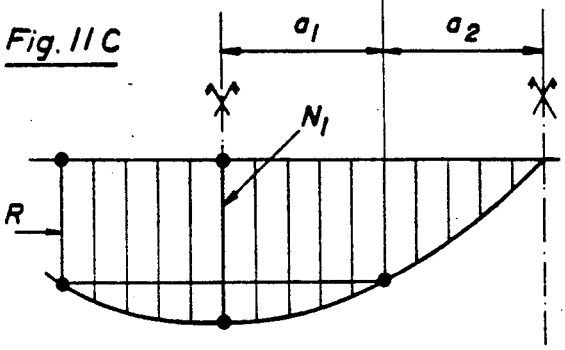
FIG. 12 is a diagram of the stresses in the deck, in the situation in FIG. 11C.

The construction of the deck of the central span can then continue towards the crown. The stays of the second family are put in place and anchored at the rear in the anchor block. The equilibrium of the system is effected by the generation of the reaction force R which reaches its maximum value when the deck is constructed as far as the crown. At this stage, the diagram of the axial forces in the deck is that of FIG. 12. The structure in this stage sustains only the dead weight of the deck, to the exclusion of the loads resulting from the equipment (roadway wearing-surface, railings, etc.). This dead weight generally represents half the total loads G + S mentioned above. The axial force $N_1$ borne by the deck at right angles to the tower is thus equal to N/2 (N having the meaning stated with respect to FIG. 10). If full use is made of the possibilities explained above (which is not necessarily the optimum overall solution) for the dividing up of the deck between the two parts $a_1$ and $a_2$ supported by the two families of stays, it can be seen that the axial force in the deck during construction ($N_1=0.5N$) is 2.5 times greater than in the structure in service ($N_1=0.2N$).

Three arrangements can be taken either separately or jointly in order to deal with this situation, if the temporary stresses in the materials exceed acceptable values:

a) changing the stressed cross-section of the deck, in particular near the towers, which will make it possible to increase the length $a_1$ to the detriment of the length $a_2$, whilst at the same time permitting the generation of higher temporary forces in the deck;

b) constructing the deck of the central part in several stages in order to reduce its weight before keying; for example, if the deck is composed of a metal framework supporting a concrete slab, this slab will be put in place only after the metal framework has been keyed;

c) reducing the value of the temporary reaction force R and, therefore, that of the axial force in the deck by balancing the symmetrical stays of the central family in pairs using ties.

Figure 14A:
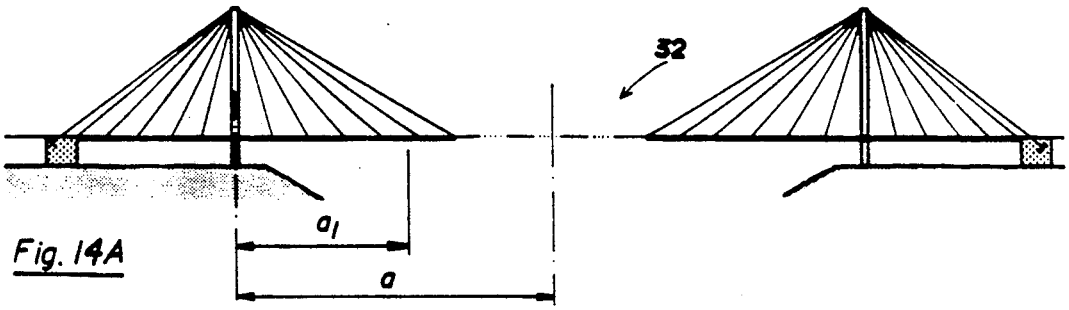
FIGS. 14A and 14B are diagrams illustrating a preferred alternative embodiment of the mode of construction.
Figure 14B:
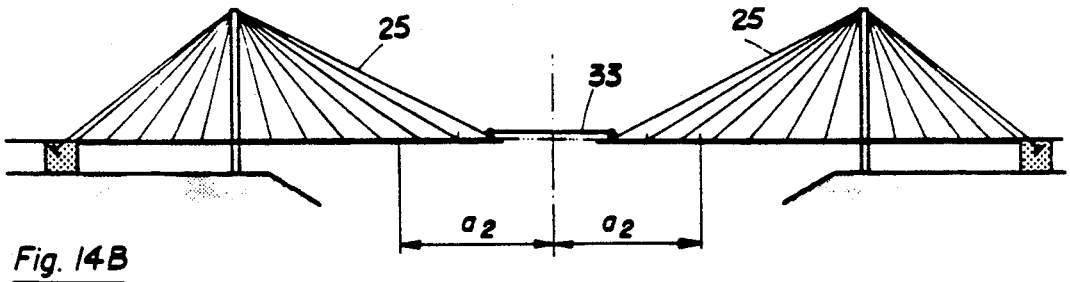
Figure 15:
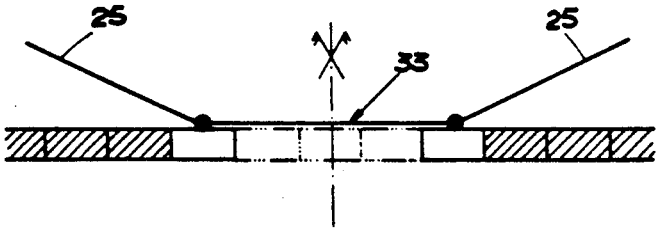
FIG. 15 is a detailed view of FIG. 14B.

This latter solution is illustrated in FIGS. 14A, 14B and 15.

Figure 11B:
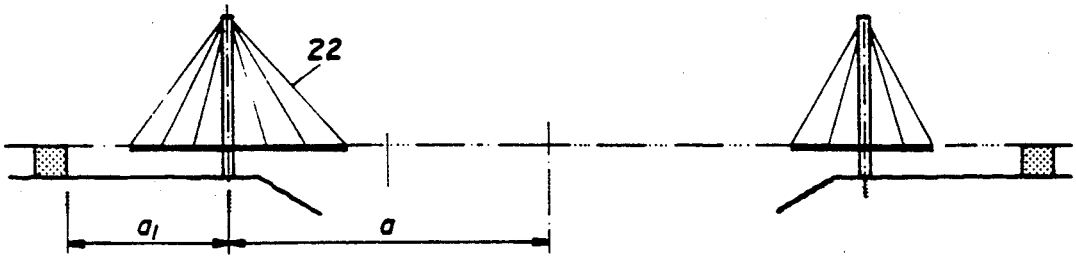
Figure 11C:
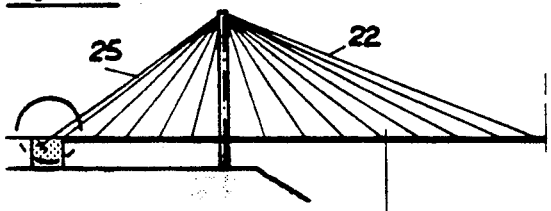

FIG. 14A shows a stage of the construction slightly after that in FIG. 11B. The conventionally cable-stayed part of the deck is complete and a small length of the central part has been built, on either side of the middle of the structure.

FIGS. 14B and 15 show that, in order to put in place an additional length 32 of deck, the ends of the corresponding stays 25 have been joined by a tie 33. The additional lengths 32 will be made integral with the assembly formed by the two stays 25 and the tie 33, which acts like the suspension cable of a suspension bridge, in other words it does not create any new axial compressive stress in the deck, or at least such a stress is considerably reduced.

Whatever the method adopted, the structure is completed by the keying of the central span at the crown and the application of the final prestress of the deck. In order to prevent excessively high compressive forces being exerted on the deck, the tensioning of the prestressing units at the centre of the main span and the controlled relaxing of the jacks at the two ends are carried out simultaneously. Once these operations are over, the deck is free from the contact with the anchor blocks by removing the jacks 31, and has its final static form.

I claim:

1. A bridge comprising a deck and at least two towers, that part of the deck which extends on either side of each tower being supported by stays which are anchored on the deck and tensioned between their anchorage points on the deck and points situated at the top of the tower or distributed over the height of the latter, longitudinal compressions in this part of the deck which result from the tensioning of the stays being approximately balanced on either side of the tower, the deck furthermore comprising a central part situated approximately half-way between two successive towers and which is supported exclusively, from these two towers, by stays which are anchored, on the one hand, in this central part of the deck, and on the other hand, on one or the other of two anchor blocks beyond the deck, and are each deflected at the top of the tower situated between said central part and said anchor block, means for subjecting said central part of the deck to an permanent axial prestress calculated in order to compensate at least partially for the tensile stress to which the central part is subjected under the effect of said stays anchored on the anchor blocks.

2. The bridge as claimed in claim 1, in which the prestress is calculated in order to balance substantially the maximum tensile load half-way between the towers.

3. The bridge as claimed in claim 1, in which a stressed cross-section of the deck changes along the length of the bridge in order to adapt to variation in forces which it sustains.

4. A method for the construction of a bridge comprising a deck and at least two towers, that part of the deck which extends on either side of each tower being supported by stays which are anchored on the deck and tensioned between their anchorage points on the deck and points situated at the top of the tower or distributed over the height of the latter, longitudinal compressions in this part of the deck which result from the tensioning of the stays being approximately balanced on either side of the tower, the deck furthermore comprising a central part situated approximately half-way between two successive towers and which is supported exclusively, from these two towers, by stays which are anchored, on the one hand, in the central part of the deck, and on the other hand, on one or the other of two anchor blocks beyond the deck, and are each deflected at the top of the tower situated between said central part and said anchor block, means for subjecting said central part of the deck to an permanent axial prestress calculated in order to compensate at least partially for the tensile stress to which the central part is subjected under the effect of said stays anchored on the anchor blocks, said method comprising the following steps:

constructing the anchor blocks contemporaneously with erecting the towers, after having erected the towers, constructing parts of the deck which are supported by stays anchored on deck parts disposed on either side of a tower, after having constructed the anchor blocks emplacing between each deck part already constructed and an adjacent anchor block, jacking means for transmitting a horizontal reaction force, constructing a central part of the deck with the aid of stays anchored in the anchor blocks, working from the deck parts already constructed and compensating for imbalance in horizontal forces with the aid of the jacking means, keying the center of the deck with keying means, and applying a prestress to the central part of the deck.

5. The method as in claim 4, in which, during the construction of the central part, symmetrical stays of the a family of stays intended to support said central part are balanced in pairs by connecting said stays together using ties fixed in proximity to their respective anchorage point on the deck.

6. The method as claimed in claim 4, in which the prestress is applied to the central part of the deck in a gradual manner by simultaneously relaxing the force of said jacking means.

7. The method as claimed in claim 4, applied to the construction of a bridge in which the stressed cross-section of the deck changes along the length of the bridge in order to adapt to variation in maximum forces which said deck must sustain during construction.

8. The method as claimed in claim 4, in which at least the central part of the deck is constructed in several stages, the keying of the center of the deck taking place before the deck has its final form and weight.

9. In a bridge of the cable-stay type, having a deck and at least two towers, that part of the deck which longitudinally extends on either side of each tower being supported by stays, said stays bearing on a top of said towers such that each said stay includes a first end anchored with anchor blocks disposed at one side of each of said towers, and a second end which are anchored on another side of each of the towers on the deck, the improvement comprising:

said deck further comprising a prestressed central portion, said prestressed central portion being approximately midway between said towers, said second ends of said stays being anchored at a selected location within said prestressed central portion of said deck, said prestressed central portion being prestressed by being subjected to an predetermined axial stress before said second ends of said stays are anchored therein, said axial stress being determined in accordance with a tensile stress determined to be created by the stays when anchored.

10. A method for prestressing a central portion of a bridge of the cable-stay type, having a deck and at least two towers, that part of the deck which longitudinally extends on either side of each tower being supported by stays, said stays bearing on a top of said towers such that each said stay includes a first end anchored with anchor blocks disposed at one side of each of said towers, and a second end anchored on another side of each of the towers on the deck, said deck further comprising a central portion located approximately midway between said towers, said second ends of said stays being anchored at a selected location within said central portion of said deck, said method of prestressing said central portion comprising the following steps:

determining an axial stress for said stays in accordance with an predetermined static load of said bridge, before one of said ends of said stays is anchored, applying an axial stress in an amount equal to said determined axial stress to said central portion of said bridge to prestress said central portion, and thereafter anchoring said stays.

* * * * *